US006547166B1

(12) United States Patent
Heren

(10) Patent No.: US 6,547,166 B1
(45) Date of Patent: Apr. 15, 2003

(54) PATTERN ADJUSTABLE FLOW NOZZLE

(75) Inventor: Lawrence P. Heren, East Peoria, IL (US)

(73) Assignee: L.R. Nelson Corporation, Peoria, IL (US)

( * ) Notice: Subject to any disclaimer, the term of this patent is extended or adjusted under 35 U.S.C. 154(b) by 0 days.

(21) Appl. No.: 09/637,189

(22) Filed: Aug. 11, 2000

(51) Int. Cl.[7] ..... B05B 1/32; B05B 9/08; A62C 31/02

(52) U.S. Cl. ..... 239/538; 390/393; 390/394; 390/530

(58) Field of Search ..... 239/538, 390, 239/393, 394, 518, 530; 222/402.1, 402.13, 402.17

(56) References Cited

U.S. PATENT DOCUMENTS

| | | | | |
|---|---|---|---|---|
| 189,328 A | | 4/1877 | Stump | |
| 977,748 A | | 12/1910 | Milburn | |
| 1,931,761 A | | 10/1933 | Hertel | 299/61 |
| 2,380,513 A | | 7/1945 | Garabedian | 299/135 |
| 2,552,445 A | | 5/1951 | Nielsen | 299/131 |
| 2,753,219 A | | 7/1956 | Matarese | 299/130 |
| 2,884,203 A | | 4/1959 | Broughton | 239/116 |
| 2,895,680 A | | 7/1959 | Tavone | 239/76 |
| 2,991,016 A | | 7/1961 | Allenbaugh | 239/458 |
| 2,991,942 A | | 7/1961 | Rosenkranz | 239/262 |
| 3,058,670 A | * | 10/1962 | Marotto et al. | 239/390 |
| 3,102,691 A | | 9/1963 | Gall | 239/456 |
| 3,112,883 A | | 12/1963 | Blanchard | 239/276 |
| 3,554,452 A | | 1/1971 | Davidson | 239/956 |
| 3,640,465 A | | 2/1972 | Hicks | 239/583 |
| 3,768,734 A | * | 10/1973 | Anderson, Jr. et al. | 239/333 |
| 3,804,338 A | | 4/1974 | Williams | 239/541 |
| 4,342,426 A | | 8/1982 | Gagliardo | 239/457 |
| 4,365,750 A | | 12/1982 | Carlberg | 239/276 |
| 4,473,190 A | | 9/1984 | Gagliardo | 239/456 |
| 4,618,100 A | * | 10/1986 | White et al. | 239/440 |
| 4,714,200 A | * | 12/1987 | Sayama | 239/579 |
| 4,732,328 A | | 3/1988 | Schydlo | 239/538 |
| 4,890,792 A | * | 1/1990 | Martin et al. | 239/538 |
| 4,903,897 A | * | 2/1990 | Hayes | 239/394 |
| 5,261,494 A | | 11/1993 | McLoughlin | 169/70 |
| 5,360,172 A | | 11/1994 | Wang | 239/586 |
| 5,386,940 A | * | 2/1995 | Berfield | 239/394 |
| 5,566,886 A | * | 10/1996 | Wang | 239/394 |
| 5,664,732 A | * | 9/1997 | Smolen, Jr. et al. | 239/121 |
| 5,749,518 A | * | 5/1998 | Wang | 239/17 |
| 6,027,042 A | * | 11/2000 | Smith | 239/337 |

FOREIGN PATENT DOCUMENTS

JP 407314681 A * 12/1995

* cited by examiner

*Primary Examiner*—Michael Mar
*Assistant Examiner*—Davis Hwu
(74) *Attorney, Agent, or Firm*—Mayer, Brown, Rowe & Maw

(57) ABSTRACT

A pattern adjustable flow nozzle which maintains a constant fluid flow rate is disclosed. The flow nozzle is comprised of two parts, an inner tubular body and an outer tubular sleeve, rotatable one on the other. Orifices are disposed on the output end of the tubular body and tubular sleeve, and the superposition of those orifices in various rotational alignments determines the throw and pattern of the ejected fluid. Flow cavities on the inner tubular body allow for a constant rate of fluid flow over the range of orifice superpositions.

14 Claims, 7 Drawing Sheets

PATTERN ADJUSTABLE FLOW NOZZLE

FIELD OF INVENTION

This invention relates to flow nozzles. More specifically, this invention relates to a flow nozzle in which the pattern and throw of the fluid flow may be adjusted while maintaining a constant rate of flow.

BACKGROUND OF INVENTION

It is well known that sprinklers and other irrigation devices allow for user control of the throw (distance) and pattern of the water stream emanating from a flow nozzle. Common sprinklers are made up of one or more sprinkler turrets connected to a common fluid source at a stable base. Each turret contains a rotating mechanism so as to provide lateral coverage of the irrigation zone. The turret terminates in a flow nozzle, oriented at various angles to the ground, typically 15 degrees. Adjustable flow nozzles allow a user to adjust the pattern and throw of the fluid stream emanating from the flow nozzle on each sprinkler turret for coverage of different areas. Typically this control is made possible by a pattern adjustment screw.

Alternatively, a sprinkler turret can terminate in an adjustable flow nozzle, which, by rotational adjustment, may be set to a desired pattern and throw. Typically the rotational motion adjusts the relative orientation of two or more orifices aligned on adjacent plates. As the stream of fluid exits the inner orifice and enters the partially open outer orifice, the fluid flow is thereby deflected, altering the pattern and throw to a desired setting.

In addition, it is desirable that the flow nozzle provide complete distance coverage. Complete distance coverage entails providing irrigation to every point from the farthest ejection to the closest point to the sprinkler turret receives irrigation along the line of the ejected fluid.

Designs employing a pattern adjustment screw have the disadvantage of complex construction, which includes numerous separate parts to operate. The alternative adjustable flow nozzles, while exhibiting a simpler construction, have the disadvantage of altering the flow rate when the throw and pattern are adjusted. Such alteration of flow rate is undesirable, as devices such as sprinklers require even, predictable irrigation,and constant and proportional water flow to prevent over watering and to conserve water.

Thus there exists a need for a flow nozzle that exhibits a simple design, allowing for throw and pattern adjustment. There is a further need for a flow nozzle that produces a relatively constant flow rate across all throw-pattern settings In addition, there is a need for a flow nozzle that provides complete distance coverage.

SUMMARY OF THE INVENTION

The present invention may be embodied in a flow nozzle connectable to a fluid source have an inner tubular body and an outer tubular sleeve. The inner tubular body has an output end and a front surface. The outer tubular sleeve is mounted on the inner tubular body for relative rotational adjustment around an axis extending lengthwise of the inner tubular body and outer tubular sleeve. An outer discharge orifice is disposed on one end of the outer tubular sleeve adjacent to the output end of the inner tubular body. The front surface has a circular discharge orifice, and is in fluid communication with a circular flow cavity. The front surface also may have a T-shaped discharge orifice, and a rectangular discharge orifice.

The outer tubular sleeve has a plurality of grooves disposed on its outer surface. The grooves are aligned parallel to the axis of the outer tubular sleeve. The outer tubular sleeve has a control knob disposed on the outer surface of the outer tubular sleeve. The outer tubular sleeve may have at least two secondary knobs disposed on its outer surface. The secondary knobs may be spaced symmetrically with respect to the control knob.

The spray nozzle may be attached to a sprinkler turret. The sprinkler turret has an open end attachable to a fluid source under pressure and an opposite coupling end. The spray nozzle has an inner tubular body having an open coupler end and an opposite end. The opposite end has an inner discharge orifice allowing fluid communication through the opposite end. The spray nozzle has an outer tubular sleeve having an open end and an opposite discharge end. The outer tubular sleeve is mounted on the inner tubular body and is rotatable around an axis extending lengthwise of the inner tubular body and the outer tubular sleeve. An outer discharge orifice is disposed on the opposite end of the outer tubular sleeve. The outer tubular sleeve may be rotated relative to the inner tubular body. The relative rotational positions create a fluid passage with a variable output shape from the inner orifice through the outer discharge orifice.

The flow nozzle may be used with a sprinkler turret, which is connectable to a fluid source. The sprinkler turret has a connector-end matable with a fluid source and a cylindrical body in fluid communication with the fluid source through the connector end. A rotatable gun is connected to the cylindrical body, and the flow nozzle is coupled to the rotatable gun, in fluid communication with the cylindrical body.

DESCRIPTION OF THE PREFERRED EMBODIMENT

Figure 1:
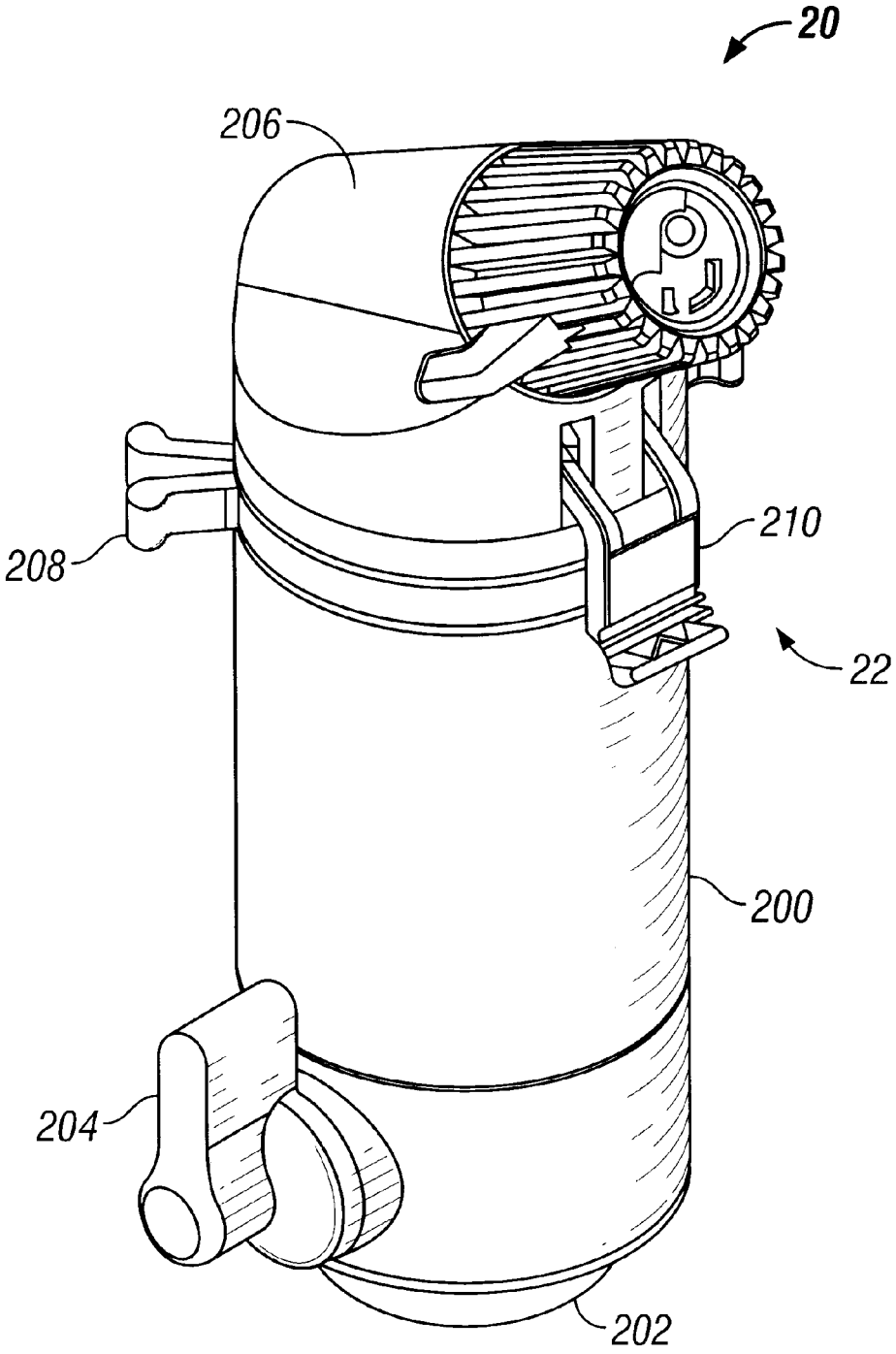
FIG. 1 is a perspective view of a flow nozzle according to one embodiment of the present invention mounted on a sprinkler turret.
Figure 2:
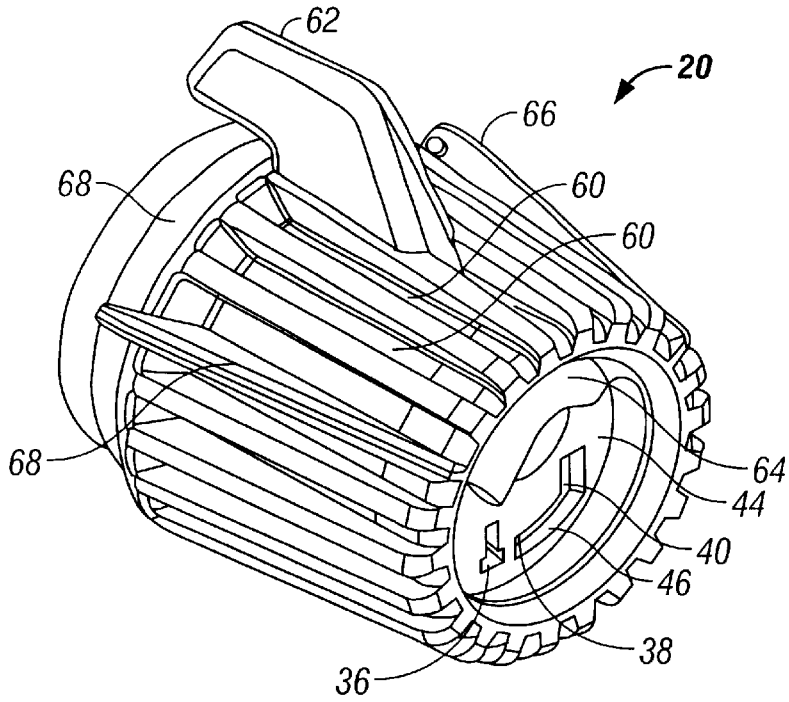
FIG. 2 is a perspective view of the flow nozzle of FIG. 1 according to one embodiment of the invention, showing an outer tubular sleeve mounted on an inner tubular body.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

FIGS. 2–10 show a flow nozzle generally indicated at 20, which is an embodiment of the present invention. The flow nozzle 20 may be mounted on a sprinkler turret 22 shown in FIG. 1. The sprinkler turret 22 has a cylindrical body 200 with a connector 202 on one end matable with a garden hose or other fluid source. The fluid flow is operated by a ball joint lever 204, which opens and closes an internal ball valve (not shown). The opposite end of the cylindrical body 200 has a rotatable gun 206 terminating in flow nozzle 20. The cylindrical body 200 and rotatable gun 206 are preferably constructed of plastic, but other materials may be used. Fluid enters the sprinkler turret 22 at the connector 202 and exits via the flow nozzle 20. The rotatable gun 206 may be set to rotate, via the rotation stops 208 and rotation lever 210. The rotation of the rotatable gun 206 serves to provide lateral irrigation coverage.

Figure 3:
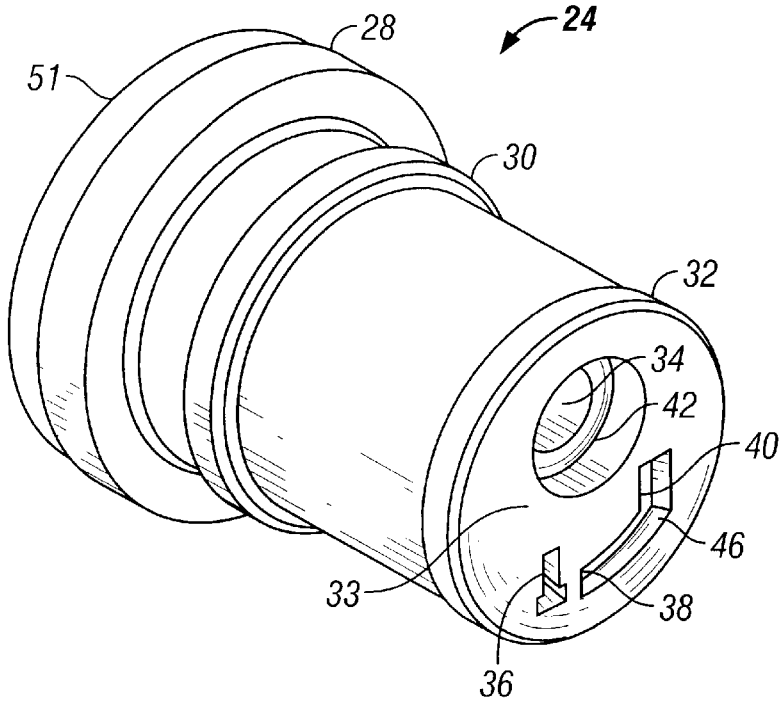
FIG. 3 is a perspective view of the inner tubular body of FIG. 2.

FIGS. 2–10 show perspective, front, rear and cross-section views of the flow nozzle 20, which includes an inner tubular body 24 and an outer tubular sleeve 26. Turning more specifically to FIG. 3, the inner tubular body 24 has base 28 which is adapted to be connected to a sprinkler turret 22 in fluid communication with a fluid source, such that the inner tubular body 24 may not be rotated with respect to the sprinkler turret 22 and hence the ground. A rear ring 30 and forward ring 32 are arranged circumferentially on the inner tubular body 24 to facilitate the mounting, retention and rotational movement of the outer tubular sleeve 26.

Figure 5:
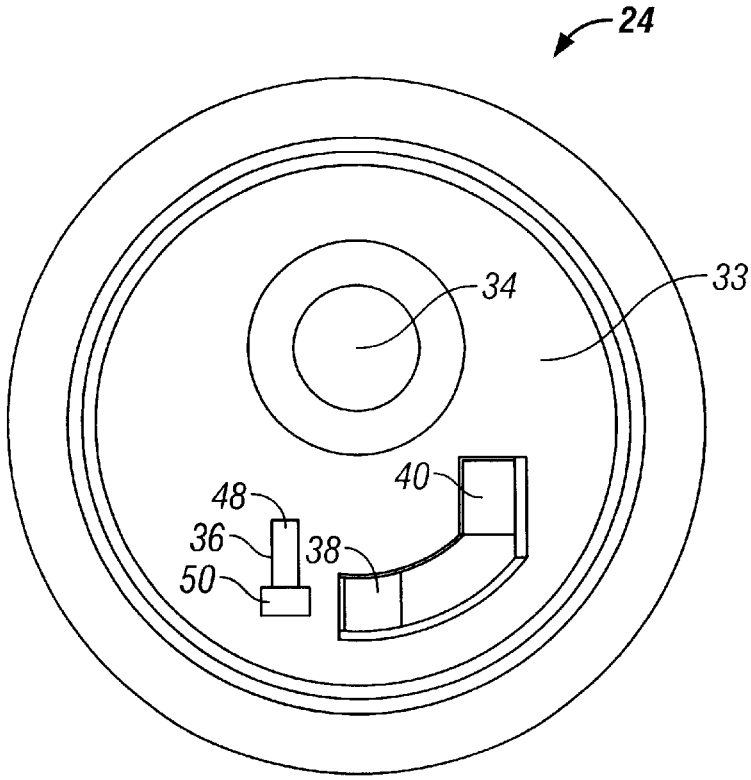
FIG. 5 is a front view of the inner tubular body of FIG. 2.

Turning more specifically to FIG. 5, the inner tubular body 24 has a front surface 33. The front surface 33 has a circular inner discharge orifice 34, a T-shaped inner discharge orifice 36, a transverse rectangular orifice 38 and a vertical rectangular orifice 40. All four discharge orifices 34, 36, 38 and 40 are in fluid communication through the inner tubular body 24. In general, the circular inner discharge orifice 34 ejects fluid the greatest distance, while the other three discharge orifices 36, 38, and 40 provide shorter distance coverage.

The circular inner discharge orifice 34 ejects the fluid into a circular flow cavity 42. An outer discharge orifice 44 is located on the outer tubular sleeve 26 so that fluid may pass through the circular flow cavity 42 into the outer discharge orifice 44. As will be discussed below, the circular flow cavity 42 ensures that the flow rate remains constant when the outer discharge orifice 44 is only partially aligned with the circular inner discharge orifice 34. The transverse rectangular orifice 38 and vertical rectangular orifice 40 eject the fluid into a spaced flow cavity 46. The spaced flow cavity 46 reduces the throw of the ejected fluid from orifices 38 and 40. The T-shaped inner discharge orifice 36 ejects the fluid directly. The T-shaped discharge orifice 36 is formed from a rectangular channel 48 and an additional flow channel 50. It is to be understood that orifices 36, 38, and 40 may be of different shapes and sizes for different throw and pattern. Additionally, either fewer or greater number of orifices may be used depending on the distance coverage desired.

Figure 6:
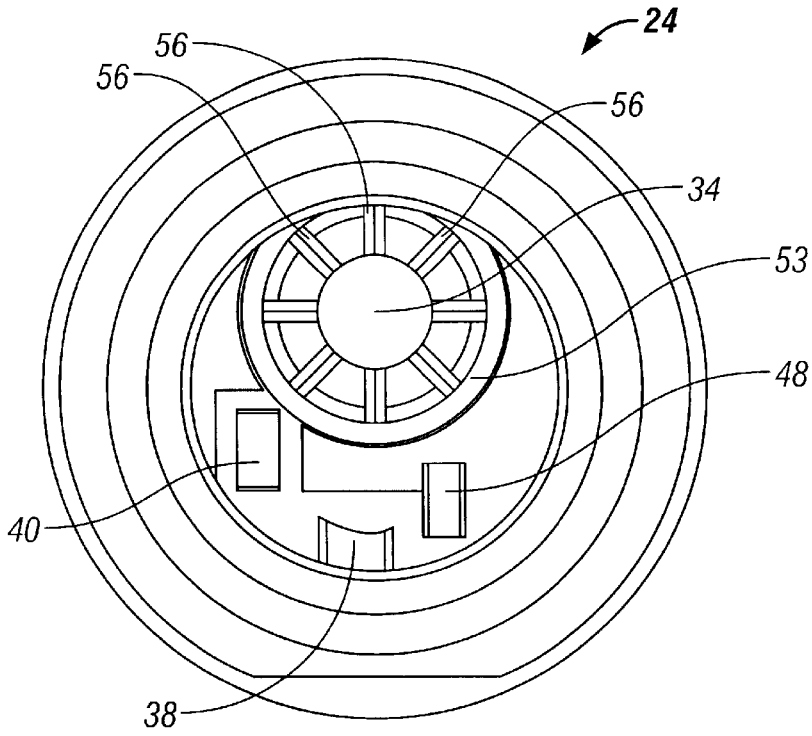
FIG. 6 is a rear view of the inner tubular body of FIG. 2.
Figure 7:
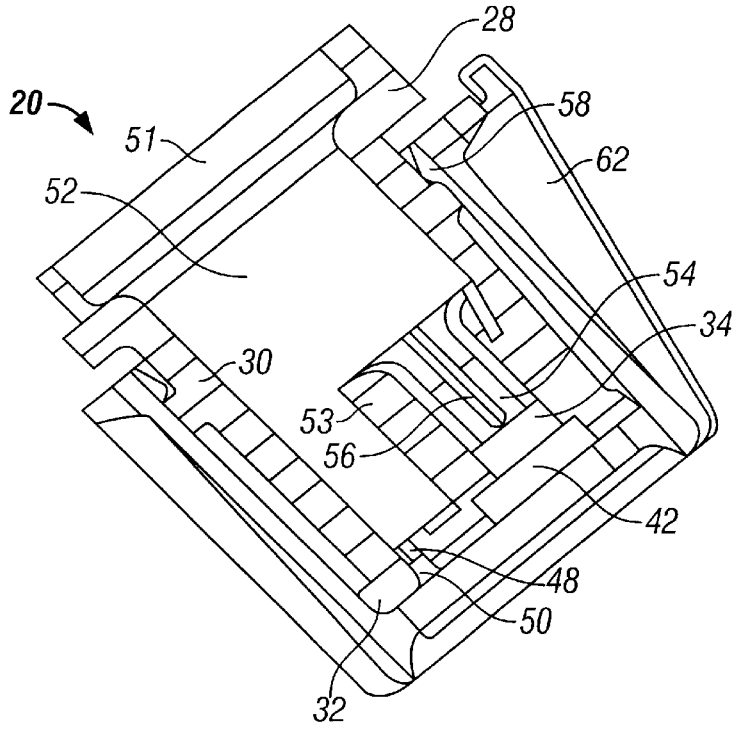
FIG. 7 is a cross-section view of the flow nozzle of FIG. 1.
Figure 8:
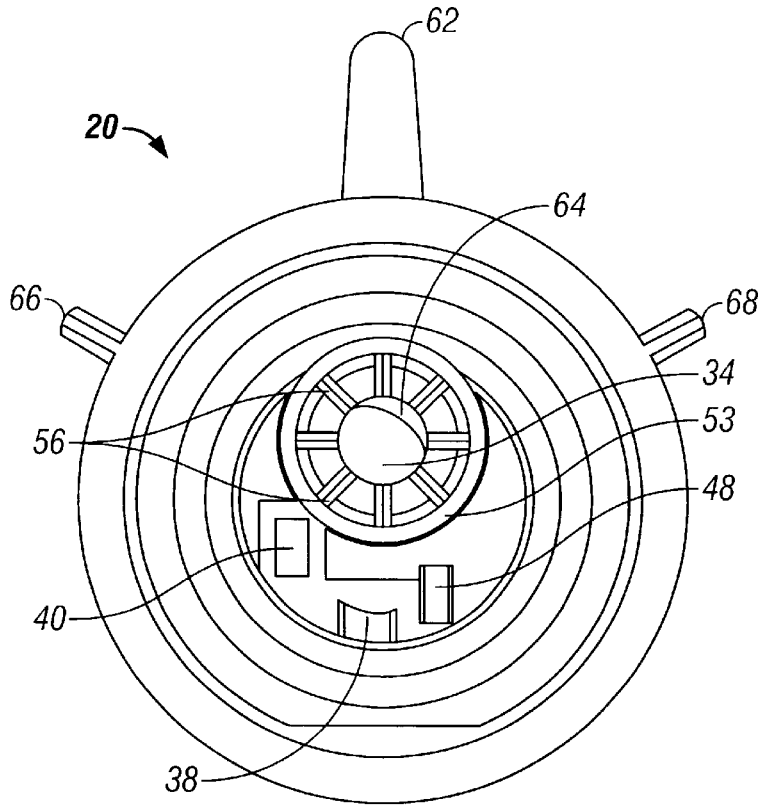
FIG. 8 is a rear view of the flow nozzle of FIG. 1, with the outer tubular sleeve mounted on the inner tubular body.

The internal structure of the inner tubular body 24 may be seen in FIGS. 6 and 7. The inner tubular body 24 has an open end 51 which forms an initial chamber 52 having a roughly cylindrical shape. The initial chamber 52 is bounded in part by a collar 53 that has a circular flow channel 54. Fluid enters the inner tubular body at the initial chamber 52 and some of the fluid proceeds through the circular flow channel 54. The circular flow channel 54 is lined with a plurality of flow veins 56, which serve to make the fluid flow more uniform and thereby allow greater throw.

The outer tubular sleeve 26 is mounted on the inner tubular body 24. The rear ring 30 and forward ring 32 seat the outer tubular sleeve 26 on the inner tubular body 24, thereby allowing relatively free rotational movement. In addition, the rear ring 30 engages the retaining ring 58 on the outer tubular sleeve 26, thereby ensuring that the outer tubular sleeve does not separate from the inner tubular body 24 during operation.

Figure 4:
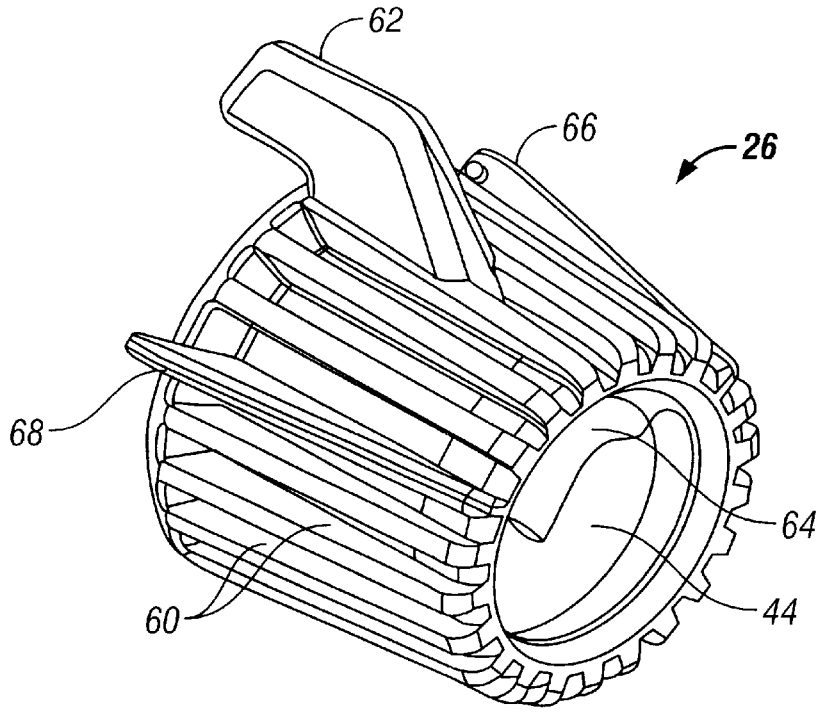
FIG. 4 is a perspective view of the outer tubular sleeve of FIG. 2.

Turning more specifically to FIG. 4, the exterior surface of the outer tubular sleeve 26 has a plurality of grooves 60 running parallel to the axis of rotation of the outer tubular sleeve 26. The grooves 60 ease operation of flow nozzle 20 by the operator, as they improve the grip when a user rotates the outer tubular sleeve 36.

The outer tubular sleeve 26 also has a control knob 62 position ed above the center of a deflection tab 64. The control knob 62 helps a user in rotating the outer tubular sleeve 26. The deflection tab 64 forms the outer discharge orifice 44. Stops (not shown) on the sprinkler turret 22 as shown in FIG. 1 can be positioned so that the rotational range of movement of the outer tubular sleeve 26 is limited, thereby defining the positions of the deflection tab 64 and outer discharge orifice 44 with respect to the inner discharge orifices 34, 36, 38, and 40. It is to be understood that various mechanisms may be used to limit the rotational range of the outer tubular sleeve 26.

Figure 9:
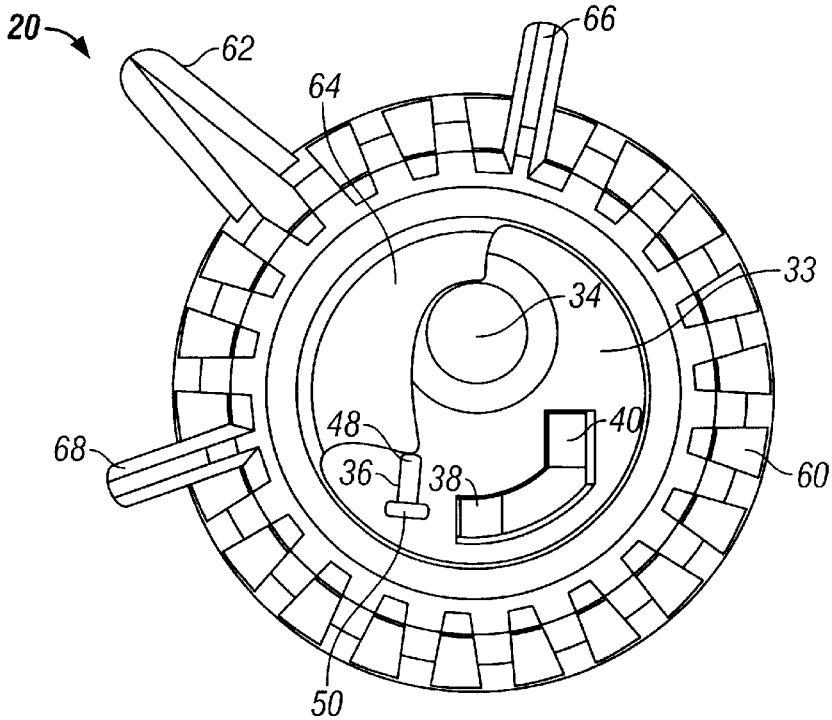
FIG. 9 is a front view of the flow nozzle of FIG. 1 with the device rotated to a position of maximum throw.
Figure 10:
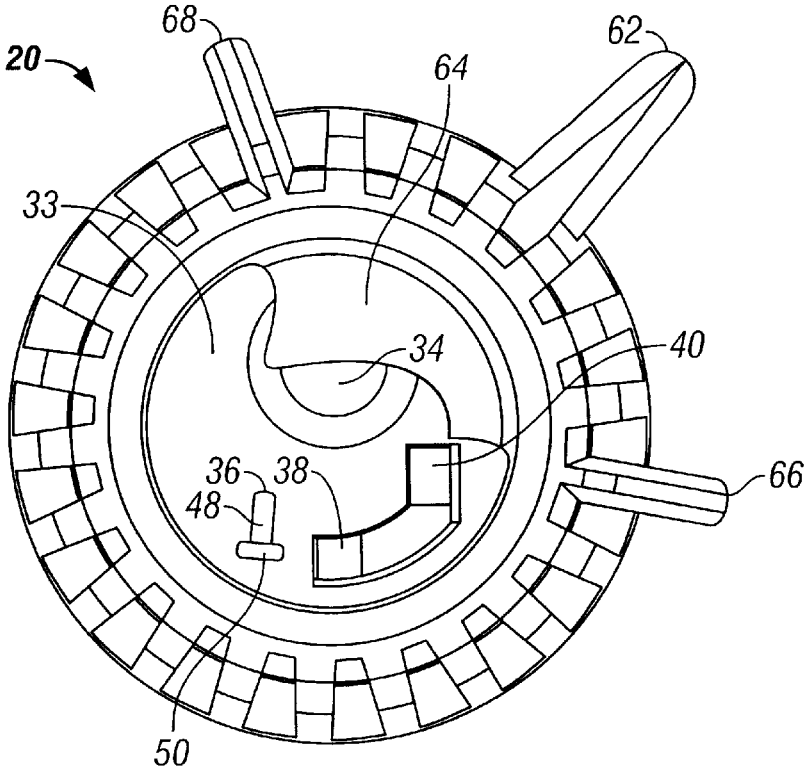
FIG. 10 is a front view of the flow nozzle of FIG. 1 with the device rotated to a position of maximum deflection.

In the preferred embodiment, the control knob 62 is limited in rotational movement to 120 degrees, and is mounted on the inner tubular body 24 so that its two rotational extremes create the juxtaposition of inner orifice 34, 36, 38 and 40 and the outer discharge orifice 44 shown in FIGS. 9 and 10. The outer tubular sleeve 26 has two secondary knobs 66 and 68 to provide additional grip and indicate the rotational limits of the outer tubular sleeve 26. In addition, the stops (not shown) on the sprinkler turret 22 may be disposed so as to engage the secondary knobs 66 and 68 and limit rotational movement of the outer tubular sleeve 26.

The flow nozzle 20 provides complete, adjustable coverage for irrigation applications. In particular, the flow nozzle 20 can be adjusted into a continuum of operative positions within the 120 degree range of rotational movement allowed by the stops (not shown). Of course, other ranges may be used. In particular, the fluid jets emanating from the T-shaped inner discharge orifice 36, the transverse rectangular orifice 38 and the vertical rectangular orifice 40 are not covered by the deflection tab 64 in any of the rotational positions of the outer tubular sleeve 26. Each of the three inner orifices 36, 38 and .40 provide irrigation coverage at various distances short of the throw of the circular inner discharge orifice 34.

As the outer tubular sleeve 26 is rotated by a user, the deflection tab 64 partially covers the circular inner discharge orifice 34. The fluid flow impacts the deflection tab 64 and is deflected down, thereby reducing the throw of the fluid flow. Furthermore, the other three discharge orifices 36, 38, and 40 are positioned such that, in its deflected position, the fluid flow from the circular inner discharge orifice 34 intersects with the other discharge flows to reduce their throws. In the deflected position, therefore, the flow nozzle 20 accomplishes complete irrigation coverage over a shorter throw.

When the flow nozzle 20 is in a position of deflected fluid flow, the flow rate of the flow nozzle 20 remains relatively constant, thereby ensuring even and predictable irrigation. In particular, the circular flow cavity 42 spaces the circular inner discharge orifice 34 from the deflection tab 64. This spacing ensures that as the deflection tab 64 is rotated so as to obscure the circular inner discharge orifice 34, the effective size of the discharge orifice remains relatively constant, thereby maintaining a constant flow rate.

Figure 11:
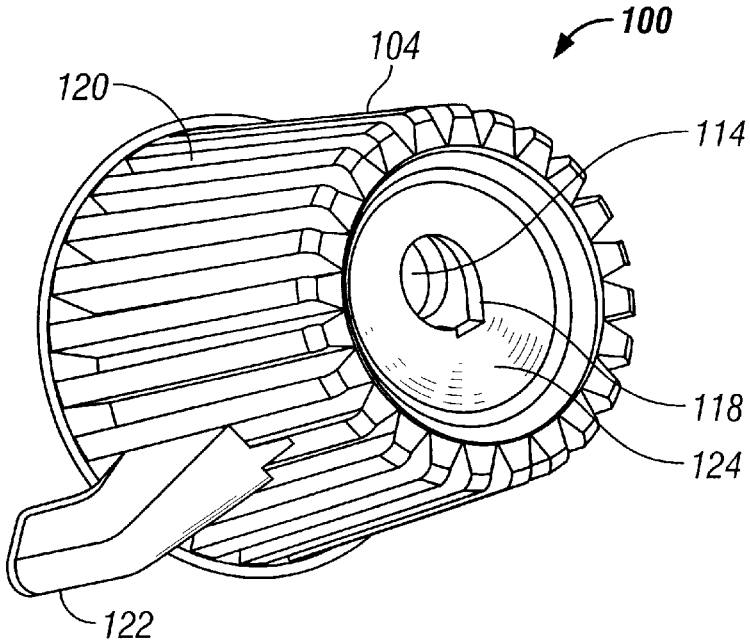
FIG. 11 is a perspective view of a second embodiment of the present invention, showing an outer tubular sleeve mounted on an inner tubular body.
Figure 12:
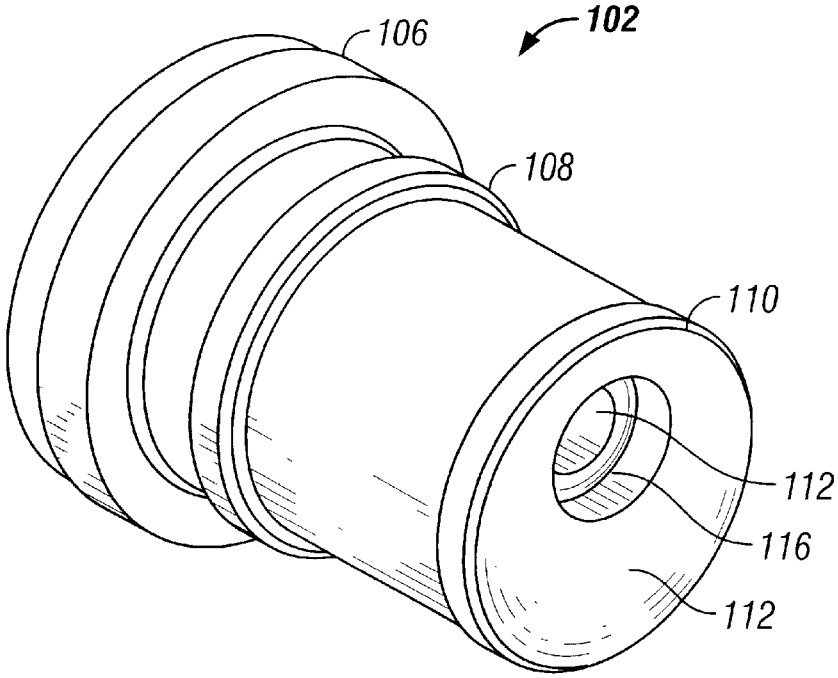
FIG. 12 is a perspective view of a second embodiment of the present invention, showing a single circular inner orifice.
Figure 13:
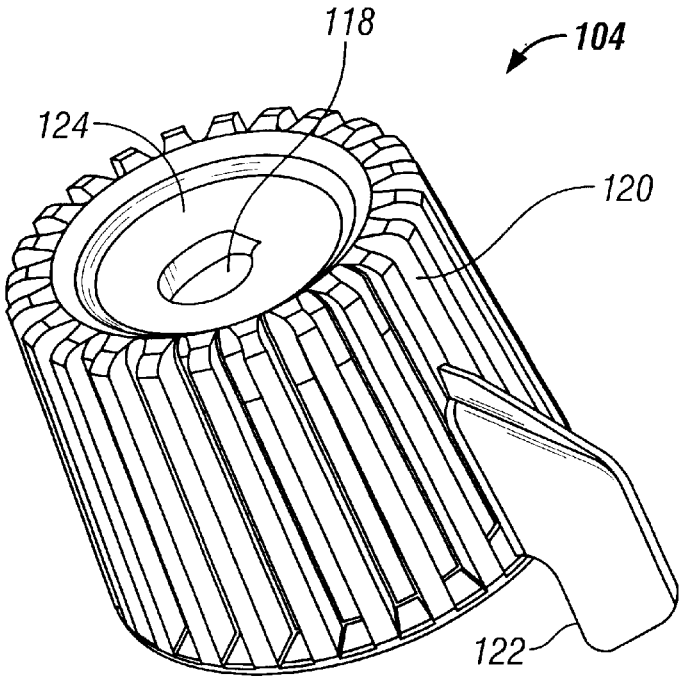
FIG. 13 is a perspective view of a second embodiment according to the present invention, showing a smaller outer discharge orifice.

Referring to FIGS. 11–13, a second embodiment of the invention is shown, generally indicated as a flow nozzle 100. The flow nozzle 100 may be mounted on a sprinkler turret 22. The flow nozzle 100 includes an inner tubular body 102 and an outer tubular sleeve 104. The inner tubular body 102 has base 106 which is adapted to be connected to a sprinkler turret such as that shown in FIG. 1 which is in fluid communication with a fluid source. The inner tubular body 102 is not rotatable with respect to the sprinkler turret and hence the ground. A rear ring 108 and forward ring 110 are arranged circumferentially on the inner tubular body 102 to facilitate the mounting, retention and rotational movement of the outer tubular sleeve 104.

The inner tubular body 102 has a front surface 112 with a circular inner discharge orifice 114, which is in fluid communication through the inner tubular body 102 with a fluid source. The circular inner discharge orifice 114 ejects the fluid into a circular flow cavity 116. An outer discharge orifice 118 is located on the outer tubular sleeve 104 so that fluid may pass through the circular flow cavity 116 into the outer discharge orifice 118. As will be discussed below, the circular flow cavity 116 ensures that the flow rate remains constant when the outer discharge orifice 118 is only partially aligned with the circular inner discharge orifice 116. It is to be understood that circular inner discharge orifice 114 may be of different shapes and sizes for different throw and pattern.

The outer tubular sleeve 104 is mounted on the inner tubular body 102. The rear ring 108 and forward ring 110 seat the outer tubular sleeve 104 on the inner tubular body 102, thereby allowing relatively free rotational movement. In addition, the rear ring 108 engages a retaining ring (not shown) on the outer tubular sleeve 104, thereby ensuring that the outer tubular sleeve does not separate from the inner tubular body 102 during operation.

The exterior surface of the outer tubular sleeve 104 has a plurality of grooves 120 running parallel to the axis of rotation of the outer tubular sleeve 104. The grooves 120 improve grip when a user rotates the outer tubular sleeve 104.

The outer tubular sleeve 104 also has a control knob 122 positioned above the center of an deflection tab 124. The control knob 122 helps a user in rotating the outer tubular sleeve 104. The deflection tab 124 forms the outer discharge orifice 118.

The control knob 122 is limited in rotational movement to 120 degrees, and is mounted on the inner tubular body 102 so that its two rotational extremes create the juxtaposition of inner orifice 112 and the outer discharge orifice 118. In one rotation extreme, the circular inner discharge orifice 114 is completely un-obscured by the deflection tab 124. In the other rotational extreme, the deflection tab 124 covers about half of the circular inner discharge orifice 114, thereby deflecting the fluid stream substantially downward.

The spray nozzle 100 provides adjustable coverage for irrigation applications. In particular, the spray nozzle 100 can be adjusted into a continuum of operative positions within the 120 degree range of rotational movement allowed by the stops (not shown). Of course, other ranges of motion may be used.

As the outer tubular sleeve 104 is rotated by a user, the deflection tab 124 partially covers the circular inner discharge orifice 114. The fluid flow impacts the deflection tab 124 and is deflected down, thereby reducing the throw of the fluid flow.

When the flow nozzle 100 is in a position of reduced throw, the flow rate of the flow nozzle 100 remains relatively constant, thereby ensuring even and predictable irrigation. In particular, the circular flow cavity 116 spaces the circular inner discharge orifice 114 from the deflection tab 124. This spacing ensures that as the deflection tab 124 is rotated so as to obscure the circular inner discharge orifice 114, the effective size of the discharge orifice remains relatively constant, thereby maintaining a constant flow rate.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A flow nozzle connectable to a fluid source, the flow nozzle comprising:

an inner tubular body having an output end and a front surface;

an outer tubular sleeve overlapping said inner tubular body and axially mounted on said inner tubular body for continuous relative rotational adjustment around an axis extending lengthwise of said inner tubular body and outer tubular sleeve wherein the outer tubular sleeve has a plurality of grooves disposed on the outer surface of said outer tubular sleeve, said grooves aligned parallel to the axis of said outer tubular sleeve;

an outer discharge orifice disposed on one end of the outer tubular sleeve adjacent to the output end of the inner tubular body;

a circular discharge orifice through the output end, wherein the circular discharge orifice and the outer discharge orifice overlap over all rotational adjustments; and a circular flow cavity on the front surface of the output end providing fluid communication between the circular discharge orifice and the outer discharge orifice, wherein a constant distance is maintained between the outer tubular sleeve and the front surface of the inner tubular body along the axis of rotation when the outer tubular sleeve is rotationally adjusted.

2. The flow nozzle of claim 1 wherein the outer tubular sleeve has a control knob disposed on the outer surface of said outer tubular sleeve.

3. The flow nozzle of claim 2 wherein two secondary knobs are spaced symmetrically with respect to the control knob.

4. The flow nozzle of claim 1 wherein the outer tubular sleeve has at least two secondary knobs disposed on the outer surface of said outer tubular sleeve.

5. A spray nozzle for attachment to a sprinkler having an open end attachable to a fluid source under pressure and an opposite coupling end, the spray nozzle comprising:

an inner tubular body having an open coupler end and an opposite discharge end having an inner discharge orifice allowing fluid communication through the opposite end;

an outer tubular sleeve having an open end and an opposite discharge end, the outer tubular sleeve overlapping said inner tubular body and axially mounted on said inner tubular body and continuously rotatable around an axis extending lengthwise of said inner tubular body and outer tubular sleeve wherein the discharge end of the inner tubular body has a second inner discharge orifice and wherein the discharge end of the outer tubular sleeve has an substantially circumferential opening which allows fluid communication through the second inner discharge orifice during the rotation of the outer tubular sleeve;

an outer discharge orifice disposed on the discharge end of the outer tubular sleeve, wherein when the outer tubular sleeve is rotated relative to the inner tubular body, a fluid passage is formed with a variable output shape from the inner orifice through the outer discharge orifice, and wherein the inner discharge orifice and the outer discharge orifice overlap over all rotational adjustments; and a flow cavity on the discharge end of the inner tubular body providing fluid communication between the circular discharge orifice and the outer discharge orifice, wherein a constant distance is maintained between the outer tubular sleeve and the discharge end of the inner tubular body along the axis of rotation when the outer tubular sleeve is rotationally adjusted.

6. The spray nozzle of claim 5 wherein the second inner discharge orifice is T-shaped.

7. The spray nozzle of claim 5 wherein the second inner discharge orifice is rectangularly shaped.

8. The spray nozzle of claim 7 wherein the discharge end of the inner tubular body has a third inner discharge orifice with a rectangular shape at a perpendicular orientation to the second inner discharge orifice.

9. The spray nozzle of claim 5 wherein the inner tubular body and the outer tubular sleeve are plastic.

10. The spray nozzle of claim 5 wherein the exterior of the outer tubular sleeve includes a knob.

11. A flow nozzle connectable to a fluid source, the flow nozzle comprising:

an inner tubular body having an output end and a front surface;

an outer tubular sleeve overlapping said inner tubular body and axially mounted on said inner tubular body for relative rotational adjustment around an axis extending lengthwise of said inner tubular body and outer tubular sleeve wherein the outer tubular sleeve has a plurality of grooves disposed on the outer surface of said outer tubular sleeve, said grooves aligned parallel to the axis of said outer tubular sleeve;

an outer discharge orifice disposed on one end of the outer tubular sleeve adjacent to the output end of the inner tubular body;

a circular discharge orifice through the output end, wherein the circular discharge orifice and the outer discharge orifice overlap over all rotational adjustments; and a circular flow cavity on the front surface of the output end providing fluid communication between the circular discharge orifice and the outer discharge orifice, wherein a constant volume of the flow cavity is maintained when the outer tubular sleeve is rotationally adjusted.

12. The flow nozzle of claim 11 wherein the outer tubular sleeve has a control knob disposed on the outer surface of said outer tubular sleeve.

13. The flow nozzle of claim 11 wherein the outer tubular sleeve has at least two secondary knobs disposed on the outer surface of said outer tubular sleeve.

14. The flow nozzle of claim 13 wherein two secondary knobs are spaced symmetrically with respect to the control knob.

* * * * *